US009738848B2

(12) United States Patent
Takata et al.

(10) Patent No.: US 9,738,848 B2
(45) Date of Patent: Aug. 22, 2017

(54) POLYFUNCTIONAL LUBRICANT COMPOSITION

(71) Applicant: ADEKA CORPORATION, Tokyo (JP)

(72) Inventors: Masahiro Takata, Tokyo (JP); Kenji Yamamoto, Tokyo (JP); Shoji Matsuda, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 0 days.

(21) Appl. No.: 14/895,320

(22) PCT Filed: May 30, 2014

(86) PCT No.: PCT/JP2014/064427
§ 371 (c)(1),
(2) Date: Dec. 2, 2015

(87) PCT Pub. No.: WO2014/196467
PCT Pub. Date: Dec. 11, 2014

(65) Prior Publication Data

US 2016/0122679 A1 May 5, 2016

(30) Foreign Application Priority Data

Jun. 3, 2013 (JP) ..... 2013-117106

(51) Int. Cl.
*C10M 137/04* (2006.01)
*C10M 169/04* (2006.01)
*C10M 105/74* (2006.01)

(52) U.S. Cl.
CPC ..... *C10M 137/04* (2013.01); *C10M 105/74* (2013.01); *C10M 169/04* (2013.01);
(Continued)

(58) Field of Classification Search
CPC combination set(s) only.
See application file for complete search history.

(56) References Cited

U.S. PATENT DOCUMENTS 3,931,023 A 1/1976 Dounchis
3,992,309 A 11/1976 Dounchis
(Continued)

FOREIGN PATENT DOCUMENTS

JP 51-41176 4/1976
JP 62-1787 1/1987
(Continued)

OTHER PUBLICATIONS

International Search Report issued Aug. 19, 2014 in International Application No. PCT/JP2014/064427.
(Continued)

*Primary Examiner* — Taiwo Oladapo
(74) *Attorney, Agent, or Firm* — Wenderoth, Lind & Ponack, L.L.P.

(57) ABSTRACT

The present invention relates to a multifunctional lubricant composition which serves as a base oil for lubrication or as an additive for lubrication, including, with respect to 100 parts by mass of phosphorus compound (A) having a specific structure specified in the Description, 26 parts by mass to 43 parts by mass of phosphorus compound (B) having a specific structure specified in the Description, 0 parts by mass to 1.3 parts by mass of phosphorus compound (C) having a specific structure specified in the Description, and a total of 0 parts by mass to 1.3 parts by mass of triphenyl phosphate and tricresyl phosphate.

5 Claims, 2 Drawing Sheets

(52) U.S. Cl.
CPC . *C10M 2219/068* (2013.01); *C10M 2223/003* (2013.01); *C10M 2223/041* (2013.01); *C10M 2223/0415* (2013.01); *C10N 2230/02* (2013.01); *C10N 2230/06* (2013.01); *C10N 2230/64* (2013.01); *C10N 2230/66* (2013.01); *C10N 2240/08* (2013.01)

(56) References Cited

U.S. PATENT DOCUMENTS

| | | | |
|---|---|---|---|
| 4,087,386 | A | 5/1978 | Dounchis |
| 5,206,404 | A | 4/1993 | Gunkel et al. |
| 6,242,631 | B1 | 6/2001 | Hombek et al. |
| 2012/0101015 | A1 | 4/2012 | Frapin et al. |

FOREIGN PATENT DOCUMENTS

| | | | |
|---|---|---|---|
| JP | 5-194558 | | 8/1993 |
| JP | 6-9661 | | 1/1994 |
| JP | 2002-526571 | | 8/2002 |
| JP | 2013-23580 | | 2/2013 |
| RU | 2 053 249 | | 1/1996 |
| RU | 2053249 | C1 * | 1/1996 |
| RU | 2 165 427 | | 4/2001 |
| WO | 2010/149690 | | 12/2010 |

OTHER PUBLICATIONS

International Search Report dated Aug. 19, 2014 in International Application No. PCT/JP2014/064427.

* cited by examiner

FIG. 2

| | Comparative Example 1 | Example 1 | Example 2 | Example 3 | Example 4 | Example 5 | Comparative Example 2 |
|---|---|---|---|---|---|---|---|
| | Compound I | Compound II | Compound III | Compound IV | Compound V | Compound VI | Compound VII |
| | Solution I | Solution II | Solution III | Solution IV | Solution V | Solution VI | Solution VII |
| Appearance of liquid before performance of solubility test | 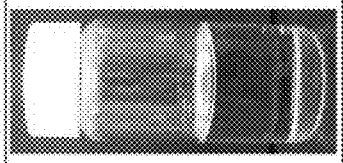 | 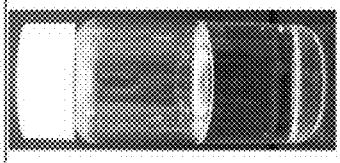 | 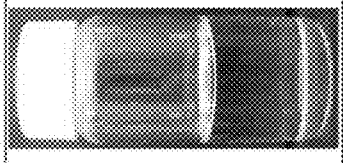 | 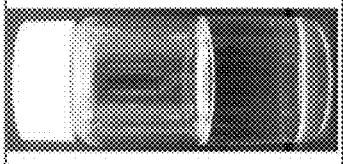 | 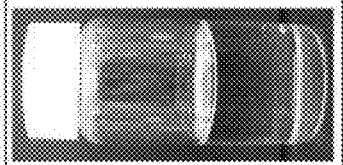 | 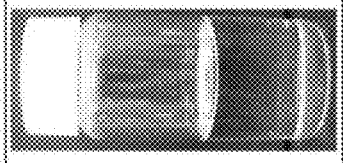 | 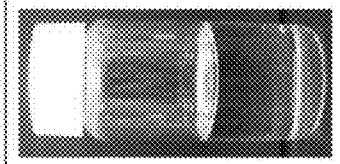 |
| Appearance of liquid after performance of solubility test |  |  |  |  |  |  |  |
| Evaluation | Δ | ○○ | ○○ | ○○ | ○○ | ○○ | ○○ |

POLYFUNCTIONAL LUBRICANT COMPOSITION

TECHNICAL FIELD

The present invention relates to a multifunctional lubricant composition comprising phosphates, which can be used as a base oil for lubrication and as an additive for lubrication.

BACKGROUND ART

Lubricating oils are oils to be used for reducing friction between parts of a machine in contact with each other, and in general, for example, mineral oils, synthetic oils, animal and vegetable oils, and mixed oils thereof have been well known as base oils for the lubricating oils. Machines requiring lubricating oils are extremely large in number and cover a broad spectrum, and hence conditions under which the machines are used and performances which the machines are required to have are also various. Accordingly, the base oils are used appropriately depending on their applications. However, when a lubricating oil is used in an aircraft or a sophisticated hydraulic system, a hydraulic oil having a high flame retardant effect is required in some cases. A synthetic flame-retardant hydraulic base oil based on a compound that hardly burns, a water-containing flame-retardant hydraulic base oil obtained by incorporating water into a hydraulic base oil to improve its flame retardancy, or the like is generally used as a flame-retardant hydraulic base oil for such hydraulic oil. Examples of the synthetic base oil include a phosphate-based compound such as tricresyl phosphate (TCP) or triphenyl phosphate (TPP), and an ester-based compound containing a polyol and a linear saturated fatty acid (Patent Literature 1). In addition, examples of the water-containing base oil include a mixture system containing water and a glycol, a water-in-oil (W/O) emulsion system where water droplets are dispersed in oil, and an oil-in-water (O/W) emulsion system where oil droplets are dispersed in water (Patent Literatures 2 and 3).

However, phosphate-based compounds such as tricresyl phosphate (TCP) or triphenyl phosphate (TPP) have high toxicity and too low a viscosity to be used as a base oil, though the compounds have flame retardancy. Accordingly, concern has been raised about its load on the environment and need for limitations on the use of oils containing the compound. In addition, ester-based compounds containing polyols and linear saturated fatty acids have low toxicity but do not have sufficient flame retardancy. On the other hand, when a water-containing base oil is used, the base oil has low toxicity and is available at a low cost, but the fact that its maintenance and management are not easy is perceived as a problem. For example, base oils are lost due to water evaporation or are corroded by mold, bacteria, fungi, and the like. That is, at present, a high-performance flame-retardant base oil that is safer and more easily used as a base oil than the related-art products are being sought in the market.

Incidentally, the examples given above are examples of a flame-retardant hydraulic base oil, and the phosphate-based compounds such as tricresyl phosphate (TCP) or triphenyl phosphate (TPP) out of those examples are also well known to have an abrasion-preventing effect not as a base oil for lubrication but as an additive for lubrication (Patent Literature 4). However, as described above, such compounds have high toxicity and hence alternative compounds have heretofore been required in the field of additives as well. To meet the requirement, in recent years, phosphorus-based abrasion-preventing agent compositions for lubrication having low toxicity have started to be developed (Patent Literature 5) and are attracting attention.

Therefore, if a phosphorus-based compound having low toxicity that can be used as a flame-retardant base oil for lubrication and also as an additive for lubrication exhibiting abrasion resistance is developed, the usefulness and novelty of the compound would be extremely high, and hence the compound can be expected to be successful in many technical fields. Accordingly, the development of such a compound having not one function alone but multiple functions has been strongly demanded in the market because the compound provides merits on both the supply side and demand side in terms of efficiency and convenience. It should be noted that the phosphorus-based abrasion-preventing agent composition for lubrication described in Patent Literature 5 is an additive having low toxicity and good abrasion resistance. However, it is impossible to use the composition as a base oil because of its high viscosity. In addition, even if the composition is used as an additive, its mixability with a lubricant base oil may be poor owing to its high viscosity, and hence it may be difficult to handle the compound.

CITATION LIST

Patent Literature

[PTL 1] JP 11-269480 A

[PTL 2] JP 2002-235093 A

[PTL 3] JP 2008-127427 A

[PTL 4] JP 09-079267 A

[PTL 5] JP 2013-023580 A

SUMMARY OF INVENTION

Technical Problem

Therefore, an object of the present invention is to provide a multifunctional lubricant composition which serves as a base oil bringing together higher safety, higher hydrolysis stability, and a better viscosity than those of existing flame-retardant base oils for lubrication, and which also exhibits high abrasion-preventing performance as an additive for lubrication.

Solution to Problem

In view of the foregoing, the inventors of the present invention have keenly investigated, and as a result, have found the present invention. Specifically, according to one embodiment of the present invention, there is provided a multifunctional lubricant composition, comprising, with respect to 100 parts by mass of phosphorus compound (A) represented by the following general formula (1), 26 parts by mass to 43 parts by mass of phosphorus compound (B) represented by the following general formula (2), 0 parts by mass to 1.3 parts by mass of phosphorus compound (C) represented by the following general formula (3), and a total of 0 parts by mass to 1.3 parts by mass of triphenyl phosphate and tricresyl phosphate.

(1)

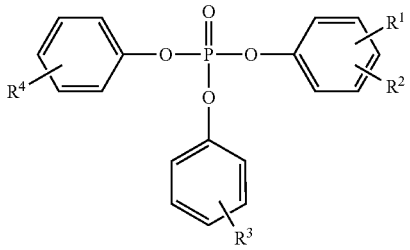

(Where, $R^1$ represents a hydrocarbon group having 1 to 10 carbon atoms, $R^2$ represents a hydrogen atom or a hydrocarbon group having 1 to 10 carbon atoms, and $R^3$ and $R^4$ each independently represent a hydrogen atom or a methyl group, provided that when $R^1$ represents a methyl group, $R^2$ does not represent a hydrogen atom.)

(2)

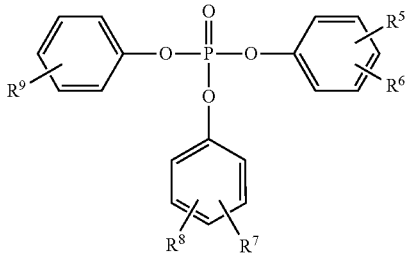

(Where, $R^5$ and $R^7$ each independently represent a hydrocarbon group having 1 to 10 carbon atoms, $R^6$ and $R^8$ each independently represent a hydrogen atom or a hydrocarbon group having 1 to 10 carbon atoms, and $R^9$ represents a hydrogen atom or a methyl group, provided that when $R^5$ represents a methyl group, $R^6$ does not represent a hydrogen atom, and that when $R^7$ represents a methyl group, $R^8$ does not represent a hydrogen atom.)

(3)

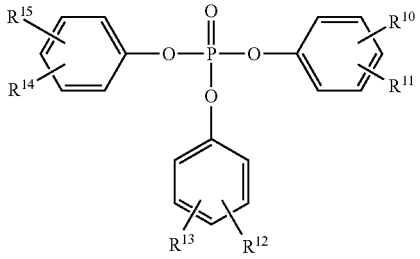

(Where, $R^{10}$, $R^{12}$, and $R^{14}$ each independently represent a hydrocarbon group having 1 to 10 carbon atoms, and $R^{11}$, $R^{13}$, and $R^{15}$ each independently represent a hydrogen atom or a methyl group, provided that when $R^{10}$ represents a methyl group, $R^{11}$ does not represent a hydrogen atom, that when $R^{12}$ represents a methyl group, $R^{13}$ does not represent a hydrogen atom, and that when $R^{14}$ represents a methyl group, $R^{15}$ does not represent a hydrogen atom.)

Advantageous Effects of Invention

The effect of the present invention lies in that the present invention provides a multifunctional lubricant composition which serves as a base oil bringing together higher safety, higher hydrolysis stability, and a better viscosity than those of existing flame-retardant base oils for lubrication, and which also exhibits high abrasion-preventing performance as an additive for lubrication.

BRIEF DESCRIPTION OF DRAWINGS

FIG. 2 shows the results of a test for solubility in a base oil comparing Compounds I to VII as additives for lubrication.

DESCRIPTION OF EMBODIMENTS

Figure 1:
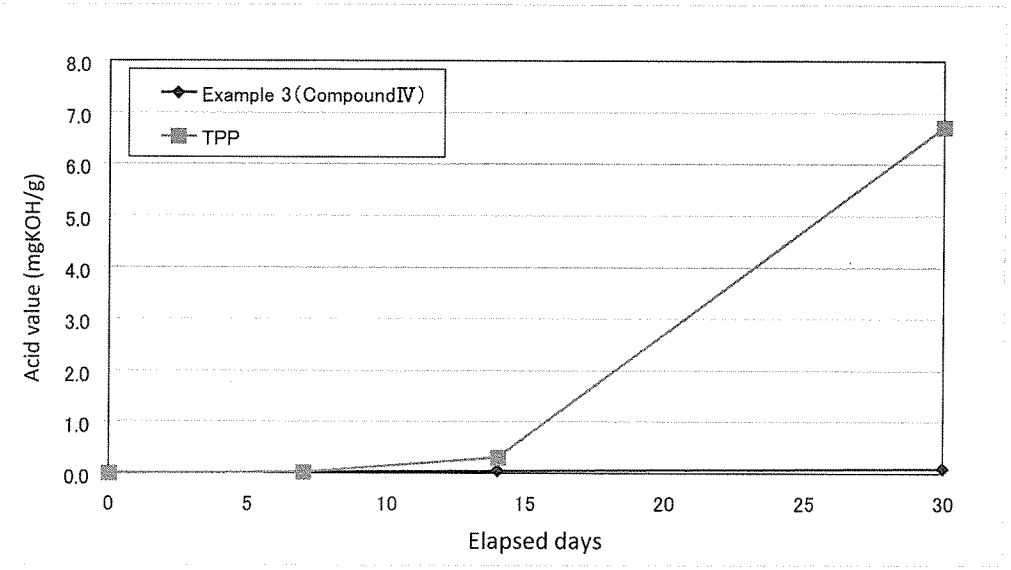
FIG. 1 is a graph for showing the results of a hydrolyzability test comparing Example 3 (Compound IV) and triphenyl phosphate (TPP) in Examples.

Herein, a compound and compound group that can be used as base oils for lubrication and can also be used as additives for lubrication are each referred to as "multifunctional lubricant composition".

A multifunctional lubricant composition of the present invention comprises, with respect to 100 parts by mass of phosphorus compound (A) represented by the following general formula (1), 26 parts by mass to 43 parts by mass of phosphorus compound (B) represented by the following general formula (2), 0 parts by mass to 1.3 parts by mass of phosphorus compound (C) represented by the following general formula (3), and a total of 0 parts by mass to 1.3 parts by mass of triphenyl phosphate and tricresyl phosphate.

(1)

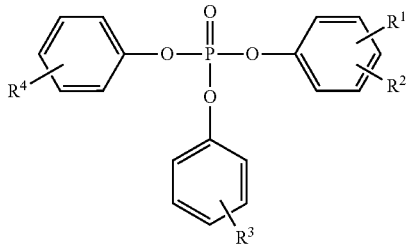

(Where, $R^1$ represents a hydrocarbon group having 1 to 10 carbon atoms, $R^2$ represents a hydrogen atom or a hydrocarbon group having 1 to 10 carbon atoms, and $R^3$ and $R^4$ each independently represent a hydrogen atom or a methyl group, provided that when $R^1$ represents a methyl group, $R^2$ does not represent a hydrogen atom.)

(2)

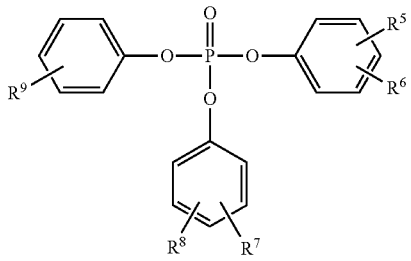

(Where, $R^5$ and $R^7$ each independently represent a hydrocarbon group having 1 to 10 carbon atoms, $R^6$ and $R^8$ each independently represent a hydrogen atom or a hydrocarbon group having 1 to 10 carbon atoms, and $R^9$ represents a hydrogen atom or a methyl group, provided that when $R^5$ represents a methyl group, $R^6$ does not represent a hydrogen atom, and that when $R^7$ represents a methyl group, $R^8$ does not represent a hydrogen atom.)

(3)

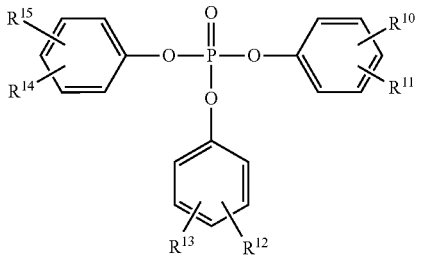

(In the formula, $R^{10}$, $R^{12}$, and $R^{14}$ each independently represent a hydrocarbon group having 1 to 10 carbon atoms, and $R^{11}$, $R^{13}$, and $R^{15}$ each independently represent a hydrogen atom or a methyl group, provided that when $R^{10}$ represents a methyl group, $R^{11}$ does not represent a hydrogen atom, that when $R^{12}$ represents a methyl group, $R^{13}$ does not represent a hydrogen atom, and that when $R^{14}$ represents a methyl group, $R^{15}$ does not represent a hydrogen atom.)

In general formula (1), $R^1$ represents a hydrocarbon group having 1 to 10 carbon atoms, and $R^2$ represents a hydrogen atom or a hydrocarbon group having 1 to 10 carbon atoms, provided that when $R^1$ represents a methyl group, $R^2$ does not represent a hydrogen atom. Examples of the hydrocarbon group having 1 to 10 carbon atoms that $R^1$ and $R^2$ may each represent include: aliphatic hydrocarbon groups such as a methyl group, an ethyl group, a n-propyl group, an isopropyl group, a n-butyl group, an isobutyl group, a s-butyl group, a t-butyl group, a n-pentyl group, a branched pentyl group, a secondary pentyl group, a tertiary pentyl group, a n-hexyl group, a branched hexyl group, a secondary hexyl group, a tertiary hexyl group, a n-heptyl group, a branched heptyl group, a secondary heptyl group, a tertiary heptyl group, a n-octyl group, a 2-ethylhexyl group, a branched octyl group, a secondary octyl group, a tertiary octyl group, a n-nonyl group, a branched nonyl group, a secondary nonyl group, a tertiary nonyl group, a n-decyl group, a branched decyl group, a secondary decyl group, and a tertiary decyl group; unsaturated aliphatic hydrocarbon groups such as an ethenyl group, a propenyl group, a butenyl group, a pentenyl group, a hexenyl group, a heptenyl group, an octenyl group, a nonenyl group, and a decenyl group (each of these groups may be linear or branched and may be primary, secondary, or tertiary); aromatic hydrocarbon groups such as a phenyl group, a tolyl group, a xylyl group, a cumenyl group, a mesityl group, a benzyl group, a phenethyl group, a styryl group, a cinnamyl group, a duryl group, a thymyl group, a carvacryl group, a benzhydryl group, a trityl group, an ethylphenyl group, a propylphenyl group, a butylphenyl group, a styrenated phenyl group, an α-naphthyl group, and a β-naphthyl group; and cycloalkyl groups such as a cyclopentyl group, a methylcyclopentyl group, an ethylcyclopentyl group, a propylcyclopentyl group, a butylcyclopentyl group, a pentylcyclopentyl group, a cyclohexyl group, a methylcyclohexyl group, an ethylcyclohexyl group, a propylcyclohexyl group, a butylcyclohexyl group, a cycloheptyl group, a methylcycloheptyl group, an ethylcycloheptyl group, a propylcycloheptyl group, a cyclopentenyl group, a methylcyclopentenyl group, an ethylcyclopentenyl group, a propylcyclopentenyl group, a butylcyclopentenyl group, a pentylcyclopentenyl group, a cyclohexenyl group, a methylcyclohexenyl group, an ethylcyclohexenyl group, a propylcyclohexenyl group, a butylcyclohexenyl group, a cycloheptenyl group, a methylcycloheptenyl group, an ethylcycloheptenyl group, and a propylcycloheptenyl group. In addition, $R^3$ and $R^4$ each independently represent a hydrogen atom or a methyl group.

Of those, a compound in which $R^1$ represents a hydrocarbon group having 2 to 8 carbon atoms, and all of $R^2$ to $R^4$ each represent a hydrogen atom is preferred, a compound in which $R^1$ represents an aliphatic hydrocarbon group having 2 to 8 carbon atoms bonded to a para position, and all of $R^2$ to $R^4$ each represent a hydrogen atom is more preferred, a compound in which $R^1$ represents an aliphatic hydrocarbon group having 2 to 5 carbon atoms bonded to a para position, and all of $R^2$ to $R^4$ each represent a hydrogen atom is still more preferred, and a compound in which $R^1$ represents a t-butyl group bonded to a para position, and all of $R^2$ to $R^4$ each represent a hydrogen atom is most preferred.

It should be noted that the term "para position" refers to a position with respect to the position at which an oxygen atom bonded to the phosphorus atom of phosphorus compound (A) is bonded to a benzene ring.

In general formula (2), $R^5$ and $R^7$ each independently represent a hydrocarbon group having 1 to 10 carbon atoms, and $R^6$ and $R^8$ each independently represent a hydrogen atom or a hydrocarbon group having 1 to 10 carbon atoms, provided that when $R^5$ represents a methyl group, $R^6$ does not represent a hydrogen atom, and that when $R^7$ represents a methyl group, $R^8$ does not represent a hydrogen atom. Examples of the hydrocarbon group having 1 to 10 carbon atoms that $R^5$ to $R^8$ may each represent include: aliphatic hydrocarbon groups such as a methyl group, an ethyl group, a n-propyl group, an isopropyl group, a n-butyl group, an isobutyl group, a s-butyl group, a t-butyl group, a n-pentyl group, a branched pentyl group, a secondary pentyl group, a tertiary pentyl group, a n-hexyl group, a branched hexyl group, a secondary hexyl group, a tertiary hexyl group, a n-heptyl group, a branched heptyl group, a secondary heptyl group, a tertiary heptyl group, a n-octyl group, a 2-ethylhexyl group, a branched octyl group, a secondary octyl group, a tertiary octyl group, a n-nonyl group, a branched nonyl group, a secondary nonyl group, a tertiary nonyl group, a n-decyl group, a branched decyl group, a secondary decyl group, and a tertiary decyl group; unsaturated aliphatic hydrocarbon groups such as an ethenyl group, a propenyl group, a butenyl group, a pentenyl group, a hexenyl group, a heptenyl group, an octenyl group, a nonenyl group, and a decenyl group (each of these groups may be linear or branched and may be primary, secondary, or tertiary); aromatic hydrocarbon groups such as a phenyl group, a tolyl group, a xylyl group, a cumenyl group, a mesityl group, a benzyl group, a phenethyl group, a styryl group, a cinnamyl group, a duryl group, a thymyl group, a carvacryl group, a benzhydryl group, a trityl group, an ethylphenyl group, a propylphenyl group, a butylphenyl group, a styrenated phenyl group, an α-naphthyl group, and a β-naphthyl group; and cycloalkyl groups such as a cyclopentyl group, a methylcyclopentyl group, an ethylcyclopentyl group, a propylcyclopentyl group, a butylcyclopentyl group, a pentylcyclopentyl group, a cyclohexyl group, a methylcyclohexyl group, an ethylcyclohexyl group, a propylcyclohexyl group, a butylcyclohexyl group, a cycloheptyl group, a methylcycloheptyl group, an ethylcycloheptyl group, a propylcycloheptyl group, a cyclopentenyl group, a methylcyclopentenyl group, an ethylcyclopentenyl group, a propylcyclopentenyl group, a butylcyclopentenyl group, a pentylcyclopentenyl group, a cyclohexenyl group, a methylcyclohexenyl group, an ethylcyclohexenyl group, a propylcyclohexenyl group, a butylcyclohexenyl group, a cycloheptenyl group, a methylcycloheptenyl group, an ethylcycloheptenyl group, and a propylcycloheptenyl group. In addition, $R^9$ represents a hydrogen atom or a methyl group.

Of those, a compound in which $R^5$ and $R^7$ each represent a hydrocarbon group having 2 to 8 carbon atoms, and all of $R^6$, $R^8$, and $R^9$ each represent a hydrogen atom is preferred, a compound in which $R^5$ and $R^7$ each represent an aliphatic hydrocarbon group having 2 to 8 carbon atoms bonded to a para position, and all of $R^6$, $R^8$, and $R^9$ each represent a hydrogen atom is more preferred, a compound in which $R^5$ and $R^7$ each represent an aliphatic hydrocarbon group having 2 to 5 carbon atoms bonded to a para position, and all of $R^6$, $R^8$, and $R^9$ each represent a hydrogen atom is still more preferred, and a compound in which $R^5$ and $R^7$ each represent a t-butyl group bonded to a para position, and all of $R^6$, $R^8$, and $R^9$ each represent a hydrogen atom is most preferred.

It should be noted that the term "para position" refers to a position with respect to the position at which an oxygen atom bonded to the phosphorus atom of phosphorus compound (B) is bonded to a benzene ring.

In general formula (3), $R^{10}$, $R^{12}$, and $R^{14}$ each independently represent a hydrocarbon group having 1 to 10 carbon atoms, and $R^{11}$, $R^{13}$, and $R^{15}$ each independently represent a hydrogen atom or a methyl group, provided that when $R^{10}$ represents a methyl group, $R^{11}$ does not represent a hydrogen atom, that when $R^{12}$ represents a methyl group, $R^{13}$ does not represent a hydrogen atom, and that when $R^{14}$ represents a methyl group, $R^{15}$ does not represent a hydrogen atom. Examples of the hydrocarbon group having 1 to 10 carbon atoms that $R^{10}$, $R^{12}$, and $R^{14}$ may each represent include: aliphatic hydrocarbon groups such as a methyl group, an ethyl group, a n-propyl group, an isopropyl group, a n-butyl group, an isobutyl group, a s-butyl group, a t-butyl group, a n-pentyl group, a branched pentyl group, a secondary pentyl group, a tertiary pentyl group, a n-hexyl group, a branched hexyl group, a secondary hexyl group, a tertiary hexyl group, a n-heptyl group, a branched heptyl group, a secondary heptyl group, a tertiary heptyl group, a n-octyl group, a 2-ethylhexyl group, a branched octyl group, a secondary octyl group, a tertiary octyl group, a n-nonyl group, a branched nonyl group, a secondary nonyl group, a tertiary nonyl group, a n-decyl group, a branched decyl group, a secondary decyl group, and a tertiary decyl group; unsaturated aliphatic hydrocarbon groups such as an ethenyl group, a propenyl group, a butenyl group, a pentenyl group, a hexenyl group, a heptenyl group, an octenyl group, a nonenyl group, and a decenyl group (each of these groups may be linear or branched and may be primary, secondary, or tertiary); aromatic hydrocarbon groups such as a phenyl group, a tolyl group, a xylyl group, a cumenyl group, a mesityl group, a benzyl group, a phenethyl group, a styryl group, a cinnamyl group, a duryl group, a thymyl group, a carvacryl group, a benzhydryl group, a trityl group, an ethylphenyl group, a propylphenyl group, a butylphenyl group, a styrenated phenyl group, an α-naphthyl group, and a β-naphthyl group; and cycloalkyl groups such as a cyclopentyl group, a methylcyclopentyl group, an ethylcyclopentyl group, a propylcyclopentyl group, a butylcyclopentyl group, a pentylcyclopentyl group, a cyclohexyl group, a methylcyclohexyl group, an ethylcyclohexyl group, a propylcyclohexyl group, a butylcyclohexyl group, a cycloheptyl group, a methylcycloheptyl group, an ethylcycloheptyl group, a propylcycloheptyl group, a cyclopentenyl group, a methylcyclopentenyl group, an ethylcyclopentenyl group, a propylcyclopentenyl group, a butylcyclopentenyl group, a pentylcyclopentenyl group, a cyclohexenyl group, a methylcyclohexenyl group, an ethylcyclohexenyl group, a propylcyclohexenyl group, a butylcyclohexenyl group, a cycloheptenyl group, a methylcycloheptenyl group, an ethylcycloheptenyl group, and a propylcycloheptenyl group.

Of those, a compound in which $R^{10}$, $R^{12}$, and $R^{14}$ each represent a hydrocarbon group having 2 to 8 carbon atoms, and all of $R^{11}$, $R^{13}$, and $R^{15}$ each represent a hydrogen atom is preferred, a compound in which $R^{10}$, $R^{12}$, and $R^{14}$ each represent an aliphatic hydrocarbon group having 2 to 8 carbon atoms bonded to a para position, and all of $R^{11}$, $R^{13}$, and $R^{15}$ each represent a hydrogen atom is more preferred, a compound in which $R^{10}$, $R^{12}$, and $R^{14}$ each represent an aliphatic hydrocarbon group having 2 to 5 carbon atoms bonded to a para position, and all of $R^{11}$, $R^{13}$, and $R^{15}$ each represent a hydrogen atom is still more preferred, and a compound in which $R^{10}$, $R^{12}$, and $R^{14}$ each represent a t-butyl group bonded to a para position, and all of $R^{11}$, $R^{13}$, and $R^{15}$ each represent a hydrogen atom is most preferred.

It should be noted that the term "para position" refers to a position with respect to the position at which an oxygen atom bonded to the phosphorus atom of phosphorus compound (C) is bonded to a benzene ring.

It should be noted that in terms of the acquisition and production of the compounds represented by general formulae (1) to (3) the $R^1$, $R^5$, $R^7$, $R^{10}$, $R^{12}$, and $R^{14}$ preferably be the same group. In addition, in this case, a compound in which $R^1$, $R^5$, $R^7$, $R^{10}$, $R^{12}$, and $R^{14}$ each represent a hydrocarbon group having 2 to 8 carbon atoms bonded to a para position, and all of $R^2$ to $R^4$, $R^6$, $R^8$, $R^9$, $R^{11}$, $R^{13}$, and $R^{15}$ each represent a hydrogen atom is more preferred, a compound in which $R^1$, $R^5$, $R^7$, $R^{10}$, $R^{12}$, and $R^{14}$ each represent a hydrocarbon group having 2 to 5 carbon atoms bonded to a para position, and all of $R^2$ to $R^4$, $R^6$, $R^8$, $R^9$, $R^{11}$, $R^{13}$, and $R^{15}$ each represent a hydrogen atom is still more preferred, and a compound in which $R^1$, $R^5$, $R^7$, $R^{10}$, $R^{12}$, and $R^{14}$ each represent a t-butyl group bonded to a para position, and all of $R^2$ to $R^4$, $R^6$, $R^8$, $R^9$, $R^{11}$, $R^{13}$, and $R^{15}$ each represent a hydrogen atom is most preferred.

The product of the present invention is a mixture formed of phosphorus compound (A) represented by general formula (1), phosphorus compound (B) represented by general formula (2), phosphorus compound (C) represented by general formula (3), triphenyl phosphate, and tricresyl phosphate, and is a multifunctional lubricant composition that can be used as a base oil for lubrication and can also be used as an additive for lubrication. When the multifunctional lubricant composition of the present invention is used as a base oil for lubrication, the composition is preferably used as a flame-retardant base oil for lubrication because its heat resistance is good. In addition, when the composition is used as an additive for lubrication, the composition is preferably used as an abrasion-preventing agent (anti-abrasion agent) for lubrication because the composition is excellent in abrasion resistance. In addition, the composition can be used in the applications of a lubricant base oil and an additive for lubrication where there is a high risk that water is included because the composition has good hydrolysis stability.

In the product of the present invention, the mixing ratio among phosphorus compound (A), phosphorus compound (B), phosphorus compound (C), triphenyl phosphate, and tricresyl phosphate is as follows: phosphorus compound (B) is used in an amount of from 26 parts by mass to 43 parts by mass, phosphorus compound (C) is used in an amount of from 0 parts by mass to 1.3 parts by mass, and triphenyl phosphate and tricresyl phosphate are used in a total amount of from 0 parts by mass to 1.3 parts by mass with respect to 100 parts by mass of phosphorus compound (A). When the amount of phosphorus compound (B) is less than 26 parts by mass, it may be difficult to use the product as an additive for lubrication because its solubility in oil deteriorates. In contrast, when the amount is more than 43 parts by mass, the product has such a high viscosity that it may be extremely difficult to use the product as a flame-retardant base oil for lubrication. When the amount of phosphorus compound (C) is more than 1.3 parts by mass, the viscosity may increase to an extent larger than that in the case where the amount of phosphorus compound (B) is too large.

Triphenyl phosphate and tricresyl phosphate were designated as class I designated chemical substances by the PRTR Law (Act on Confirmation, etc. of Release Amounts of Specific Chemical Substances in the Environment and Promotion of Improvements to the Management Thereof) in 2009 because of high toxicity of each of these compounds per se. Accordingly, it is preferred that the total amount of both the compounds be from 0 parts by mass to 1.0 part by mass, it is more preferred that the total amount be from 0 parts by mass to 0.5 part by mass, and it is most preferred that the composition be free of the compounds. When the amount is more than 1.3 parts by mass, conservation of the natural environment may be hindered. In addition, when the multifunctional lubricant composition of the present invention is used in a situation where water may be mixed, a large content of triphenyl phosphate may raise the hydrolyzability of the composition. Specifically, it is preferred that the content be from 0 parts by mass to 1.0 part by mass, it is more preferred that the content be from 0 parts by mass to 0.5 part by mass, and it is most preferred that the composition be free of triphenyl phosphate. That is, in order that the multifunctional lubricant composition can be used as a flame-retardant base oil for lubrication and as an abrasion-preventing agent for lubrication, the composition ratio (balance) among phosphorus compounds (A) to (C), triphenyl phosphate, and tricresyl phosphate is extremely important, and when the composition ratio (balance) is broken, one or both of the function as a flame-retardant base oil for lubrication and the function as an anti-abrasion agent for lubrication may be lost.

A method of producing the multifunctional lubricant composition of the present invention is not particularly limited, and no problem occurs as long as the composition is produced by a known production method. For example, no problem occurs even when a composition containing, with respect to 100 parts by mass of phosphorus compound (A), 26 parts by mass to 43 parts by mass of phosphorus compound (B), 0 parts by mass to 1.3 parts by mass of phosphorus compound (C), and a total of 0 parts by mass to 1.3 parts by mass of triphenyl phosphate and tricresyl phosphate is synthesized in one step by adjusting a loading ratio among the raw materials. In addition, no problem occurs even when only phosphorus compound (A), only phosphorus compound (B), and only phosphorus compound (C) are produced individually, and the compounds are then blended to provide a composition.

The following method is given as an example of the method of obtaining the multifunctional lubricant composition of the present invention.

<Method 1>

First, one or more kinds of phenol compounds having one substituent and/or one or more kinds of cresol compounds having one substituent are/is caused to react with diphenyl chlorophosphate and/or dicresyl chlorophosphate in the presence of a suitable catalyst and under a nitrogen atmosphere to provide phosphorus compound (A) represented by general formula (1). Next, one or more kinds of phenol compounds having one substituent and/or one or more kinds of cresol compounds having one substituent are/is caused to react with phenyl dichlorophosphate and/or cresyl dichlorophosphate in the presence of a suitable catalyst and under a nitrogen atmosphere to provide phosphorus compound (B) represented by general formula (2). Subsequently, one or more kinds of phenol compounds having one substituent and/or one or more kinds of cresol compounds having one substituent are/is caused to react with phosphorus oxychloride in the presence of a suitable catalyst and under a nitrogen atmosphere to provide phosphorus compound (C) represented by general formula (3). In each of the reactions, hydrochloric acid and the like present in a reaction system are preferably removed under reduced pressure. The pressure in the reaction system may be reduced after the reaction, or may be reduced continuously, intermittently, or temporarily during the reaction. Finally, 100 parts by mass of the resultant phosphorus compound (A) are blended with 26 parts by mass to 43 parts by mass of the phosphorus compound (B) and 0 parts by mass to 1.3 parts by mass of phosphorus compound (C). Thus, the multifunctional lubricant composition of the present invention is obtained.

<Method 2>

First, one or more kinds of phenol compounds having one substituent and/or one or more kinds of cresol compounds having one substituent are/is added to phosphorus oxychloride in the presence of a suitable catalyst and under a nitrogen atmosphere, and the mixture is subjected to a reaction. After that, phenol and/or cresol are/is loaded into the same system, and the mixture is subjected to a reaction to provide the multifunctional lubricant composition of the present invention.

At this time, the phenol compound and/or the cresol compound are/is added in a total amount of from 1.1 mol to 1.3 mol, preferably from 1.18 mol to 1.28 mol with respect to 1 mol of phosphorus oxychloride. In addition, phenol and/or cresol are/is added in a total amount of from 1.7 mol to 1.9 mol, preferably from 1.72 mol to 1.82 mol with respect to 1 mol of phosphorus oxychloride. Here, when one or more kinds of the phenol compounds each having one substituent and/or one or more kinds of the cresol compounds each having one substituent are used in the reaction, the compounds may be collectively added to phosphorus oxychloride, or may be added in batches in consideration of the reaction state. In addition, hydrochloric acid and the like present in the reaction system are preferably removed under reduced pressure. The pressure in the reaction system may be reduced after the reaction, or may be reduced continuously, intermittently, or temporarily during the reaction.

Here, the term "phenol compound having one substituent" refers to a compound which has substituents corresponding to $R^1$, $R^5$, $R^7$, $R^{10}$, $R^{12}$, and $R^{14}$, and in which $R^2$, $R^6$, $R^8$, $R^{11}$, $R^{13}$, and $R^{15}$ each represent a hydrogen atom out of the compounds represented by general formulae (1) to (3). In addition, the term "cresol compound having one substituent" refers to a compound which has substituents corresponding to $R^1$, $R^5$, $R^7$, $R^{10}$, $R^{12}$, and $R^{14}$, and in which $R^2$, $R^6$, $R^8$, $R^{11}$, $R^{13}$, and $R^{15}$ each represent a methyl group out of the compounds represented by the general formulae (1) to (3). Examples of the compound corresponding to the phenol compound include: alkylphenols such as ethylphenol, n-propylphenol, isopropylphenol, n-butylphenol, t-butylphenol, pentylphenol, hexylphenol, heptylphenol, n-octylphenol, and 2-ethylhexylphenol; alkenylphenols such as ethenylphenol, propenylphenol, butenylphenol, pentenylphenol, hexenylphenol, heptenylphenol, and octenylphenol; phenols each having a group with an aromatic ring such as phenylphenol, tolylphenol, xylylphenol, cumenylphenol, mesitylphenol, benzylphenol, and phenethylphenol; and phenols each having a group with a cyclo ring such as cyclopentylphenol, alkylcyclopentylphenols, cyclohexylphenol, and alkylcyclohexylphenols. Of those, alkylphenols and alkenylphenols are preferred, and alkylphenols are most preferred. It should be noted that the alkyl group of the alkylphenol is typically an alkyl group having 1 to 10 carbon atoms, preferably an alkyl group having 2 to 5 carbon atoms, more preferably a t-butyl group, most preferably a t-butyl group positioned at a para position with respect to the hydroxyl group of phenol.

In addition, examples of the compound corresponding to the cresol compound include: alkylcresols such as ethylcresol, n-propylcresol, isopropylcresol, n-butylcresol, t-butylcresol, pentylcresol, hexylcresol, heptylcresol, n-octylcresol, and 2-ethylhexylcresol; alkenylcresols such as ethenylcresol, propenylcresol, butenylcresol, pentenylcresol, hexenylcresol, heptenylcresol, and octenylcresol; cresols each having a group with an aromatic ring such as phenylcresol, tolylcresol, xylylcresol, cumenylcresol, mesitylcresol, benzylcresol, and phenethylcresol; cresols each having a group with a cyclo ring such as cyclopentylcresol, alkylcyclopentylcresols, cyclohexylcresol, and alkylcyclohexylcresols. Of those, alkylcresols and alkenylcresols are preferred, and alkylcresols are most preferred. It should be noted that the alkyl group of the alkylcresol is typically an alkyl group having 1 to 10 carbon atoms, preferably an alkyl group having 2 to 5 carbon atoms, more preferably a t-butyl group, most preferably a t-butyl group positioned at a para position with respect to the hydroxyl group of cresol.

It should be noted that only one kind of the phenol compound or the cresol compound is preferably used in consideration of the convenience of the reaction operation.

In addition, although the multifunctional lubricant composition of the present invention may be obtained by employing Method 1 described above or may be obtained by employing Method 2 described above, it is preferable to employ Method 2 because the composition is obtained simply and in a short time period.

Here, when the multifunctional lubricant composition of the present invention is used as a flame-retardant base oil for lubrication, its viscosity required as a base oil preferably falls within the range of from 30 $mm^2/s$ to 55 $mm^2/s$ in terms of a kinematic viscosity at 40° C. This is due to the following reasons. When the viscosity is less than 30 $mm^2/s$, the composition may not function as a lubricant base oil, and for example, oil film shortage at the time of an oil temperature increase (due to the thinning of the oil film) may be liable to occur. In addition, when the viscosity is more than 55 $mm^2/s$, the viscosity is so high that it may be difficult to use the composition as a base oil. Specifically, the base oil is used in a large amount, and hence when the viscosity is excessively high, the handleability of the base oil is poor and the step of removing the base oil from a container becomes difficult (treatment such as heating needs to be performed as required) in some cases. In addition, the loss of the base oil (corresponding to an amount remaining in the container) may be larger than that of a low-viscosity base oil, and it may be more difficult to handle the base oil in a cold region in comparison to when handling it in a warm region. Further, a large mechanical force is needed for stirring the base oil, and when any other additive or the like is dissolved in the base oil, excessive labor (such as heat treatment) and time may be required. In addition, at the time of stirring, the risk that the base oil produces bubbles increases, and hence the area of contact of the base oil with the air is increased by influences of the bubbles and its deterioration is accelerated in some cases.

In addition, the composition may be used in combination with any other base oil as long as the effects of the present invention are not impaired. Specifically, the other base oil is appropriately selected from a mineral base oil, a chemical synthetic base oil, and animal and vegetable base oils depending on its intended purpose and use conditions. One kind of those various base oils may be used alone, or two or more kinds thereof may be used in combination.

When the multifunctional lubricant composition of the present invention is used as a flame-retardant base oil for lubrication, a known additive for lubrication can be appropriately used depending on its intended purpose as long as the effects of the present invention are not impaired. It is preferred that 0.001 part by mass to 40 parts by mass of one or more kinds of compounds selected from, for example, abrasion-preventing agents, extreme pressure agents, friction modifiers, metal-based cleaning agents, ashless dispersants, antioxidants, friction-reducing agents, viscosity index improvers, pour-point depressants, rust inhibitors, corrosion inhibitors, load-withstanding additives, antifoaming agents, metal deactivators, emulsifiers, demulsifiers, and antimold agents except the multifunctional lubricant composition of the present invention be incorporated with respect to 100 parts by mass of the multifunctional lubricant composition of the present invention.

When the multifunctional lubricant composition of the present invention is used as a flame-retardant base oil for lubrication, the composition exhibits an abrasion-preventing agent effect as an additive for lubrication as well, but any other abrasion-preventing agent may be used in combination with the composition. Examples of the abrasion-preventing agent or the extreme pressure agent except the multifunctional lubricant composition of the present invention include: sulfur-based additives such as sulfurized oils and fats, olefin polysulfides, olefin sulfides, dibenzyl sulfide, ethyl-3-[[bis(1-methylethoxy)phosphinothioyl]thio]propionate, tris-[(2 or 4)-isoalkylphenol]thiophosphates, 3-(diisobutoxy-thiophosphorylsulfanyl)-2-methyl-propionic acid, triphenyl phosphorothionate, β-dithiophosphorylated propionic acid, methylenebis(dibutyldithiocarbamate), O,O-diisopropyl-dithiophosphorylethyl propionate, 2,5-bis(n-nonyldithio)-1,3,4-thiadiazole, 2,5-bis(1,1,3,3-tetramethylbutanethio)-1,3,4-thiadiazole, and 2,5-bis(1,1,3,3-tetramethyldithio)-1,3,4-thiadiazole; phosphorus-based compounds such as monooctyl phosphate, dioctyl phosphate, trioctyl phosphate, monobutyl phosphate, dibutyl phosphate, tributyl phosphate, monophenyl phosphate, diphenyl phosphate, monoisopropylphenyl phosphate, diisopropylphenyl phosphate, triisopropylphenyl phosphate, triphenyl thiophosphate, monooctyl phosphite, dioctyl phosphite, trioctyl phosphite, monobutyl phosphite, dibutyl phosphite, tributyl phosphite, monophenyl phosphite, diphenyl phosphite, triphenyl phosphite, monoisopropylphenyl phosphite, diisopropylphenyl phosphite, triisopropylphenyl phosphite, mono-tert-butylphenyl phosphite, di-tert-butylphenyl phosphite, and tri-tert-butylphenyl phosphite; organometallic compounds such as zinc dithiophosphates (ZnDTP) represented by general formula (4), dithiophosphoric acid metal salts (Sb, Mo, and the like), dithiocarbamic acid metal salts (Zn, Sb, Mo, and the like), naphthenic acid metal salts, fatty acid metal salts, phosphoric acid metal salts, phosphoric acid ester metal salts, and phosphorous acid ester metal salts; and boron compounds, alkylamine salts of mono- and dihexyl phosphates, phosphoric acid ester amine salts, and mixtures of triphenyl thiophosphoric acid esters and tert-butylphenyl derivatives.

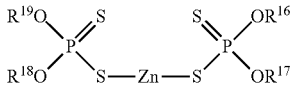

(4)

(Where, $R^{16}$ to $R^{19}$ each independently represent a primary alkyl group or a secondary alkyl group having 1 to 20 carbon atoms or an aryl group.)

In general formula (4), $R^{16}$ to $R^{19}$ each independently represent a hydrocarbon group having 1 to 20 carbon atoms, and examples of such group include: primary alkyl groups such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an icosyl group; secondary alkyl groups such as a secondary propyl group, a secondary butyl group, a secondary pentyl group, a secondary hexyl group, a secondary heptyl group, a secondary octyl group, a secondary nonyl group, a secondary decyl group, a secondary undecyl group, a secondary dodecyl group, a secondary tridecyl group, a secondary tetradecyl group, a secondary pentadecyl group, a secondary hexadecyl group, a secondary heptadecyl group, a secondary octadecyl group, a secondary nonadecyl group, and a secondary icosyl group; tertiary alkyl groups such as a tertiary butyl group, a tertiary pentyl group, a tertiary hexyl group, a tertiary heptyl group, a tertiary octyl group, a tertiary nonyl group, a tertiary decyl group, a tertiary undecyl group, a tertiary dodecyl group, a tertiary tridecyl group, a tertiary tetradecyl group, a tertiary pentadecyl group, a tertiary hexadecyl group, a tertiary heptadecyl group, a tertiary octadecyl group, a tertiary nonadecyl group, and a tertiary icosyl group; branched alkyl groups such as a branched propyl group (e.g., an isopropyl group), a branched butyl group (e.g., an isobutyl group), a branched pentyl group (e.g., an isopentyl group), a branched hexyl group (isohexyl group), a branched heptyl group (isoheptyl group), branched octyl groups (e.g., an isooctyl group and a 2-ethylhexyl group), a branched nonyl group (e.g., an isononyl group), a branched decyl group (e.g., an isodecyl group), a branched undecyl group (e.g., an isoundecyl group), a branched dodecyl group (e.g., an isododecyl group), a branched tridecyl group (e.g., an isotridecyl group), a branched tetradecyl group (isotetradecyl group), a branched pentadecyl group (e.g., an isopentadecyl group), a branched hexadecyl group (isohexadecyl group), a branched heptadecyl group (e.g., an isoheptadecyl group), a branched octadecyl group (e.g., an isooctadecyl group), a branched nonadecyl group (e.g., an isononadecyl group), and a branched icosyl group (e.g., an isoicosyl group); and aryl groups such as a phenyl group, a tolyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, and a benzylphenyl group. The blending amount of such abrasion-preventing agent is preferably from 0.01 mass % to 3 mass %, more preferably from 0.05 mass % to 2 mass % with respect to the base oil.

Examples of the friction modifier include: higher alcohols such as oleyl alcohol, stearyl alcohol, and lauryl alcohol; fatty acids such as oleic acid, stearic acid, and lauric acid; esters such as glyceryl oleate, glyceryl stearate, glyceryl laurate, an alkylglyceryl ester, an alkenylglyceryl ester, an alkynylglyceryl ester, ethylene glycol oleic acid ester, ethylene glycol stearic acid ester, ethylene glycol lauric acid ester, propylene glycol oleic acid ester, propylene glycol stearic acid ester, and propylene glycol lauric acid ester; amides such as oleylamide, stearylamide, laurylamide, an alkylamide, an alkenylamide, and an alkynyl amide; amines such as oleylamine, stearylamine, laurylamine, an alkylamine, an alkenylamine, an alkynylamine, cocobis(2-hydroxyethyl)amine, tallow bis(2-hydroxyethyl)amine, N-(2-hydroxyhexadecyl)diethanolamine, and dimethyl tallow tertiary amine; and ethers such as oleyl glyceryl ether, stearyl glyceryl ether, lauryl glyceryl ether, an alkyl glyceryl ether, an alkenyl glyceryl ether, and an alkynyl glyceryl ether. The blending amount of such friction modifier is preferably from 0.1 mass % to 5 mass %, more preferably from 0.2 mass % to 3 mass % with respect to the base oil.

Examples of the metal-based cleaning agent include sulfonates, phenates, salicylates, and phosphates of calcium, magnesium, and barium, and overbased salts thereof. Of those, overbased salts are preferred, and out of the overbased salts, an overbased salt having a total basic number (TBN) of from 10 mgKOH/g to 500 mgKOH/g is more preferred. The blending amount of such metal-based cleaning agent is preferably from 0.5 mass % to 10 mass %, more preferably from 1 mass % to 8 mass % with respect to the base oil.

Any ashless dispersant used in a lubricating oil can be used as the ashless dispersant without any particular limitation. As the ashless dispersant, for example, nitrogen-containing compounds having at least one linear or branched alkyl group or alkenyl group having 40 to 400 carbon atoms in a molecule thereof, or derivatives thereof are exemplified. Specific examples of the nitrogen-containing compounds include succinimide, succinamide, succinic acid esters, succinic acid ester-amides, benzylamine, polyamine, polysuccinimide, and Mannich bases, and specific examples of the derivative thereof include products each obtained by subjecting any one of these nitrogen-containing compounds to a reaction with boron compounds such as boric acid or boric acid salts, phosphorus compounds such as thiophosphoric acid or thiophosphoric acid salts, organic acids, and hydroxypolyoxyalkylene carbonates. When the number of carbon atoms of the alkyl group or the alkenyl group is less than 40, the solubility of the compound in a lubricant base oil may reduce. On the other hand, when the number of carbon atoms of the alkyl group or the alkenyl group is more than 400, the low-temperature fluidity of a lubricating oil composition may deteriorate. The blending amount of such ashless dispersant is preferably from 0.5 mass % to 10 mass %, more preferably from 1 mass % to 8 mass % with respect to the base oil.

Examples of the antioxidant include: phenol-based antioxidants such as 2,6-di-tert-butylphenol (tert-butyl is hereinafter abbreviated as t-butyl), 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, stearyl 3-(4-hydroxy-3,5-di-t-butylphenyl)propionate, oleyl 3-(4-hydroxy-3,5-di-t-butylphenyl)propionate, dodecyl 3-(4-hydroxy-3,5-di-t-butylphenyl)propionate, decyl 3-(4-hydroxy-3,5-di-t-butylphenyl)propionate, octyl 3-(4-hydroxy-3,5-di-t-butylphenyl)propionate, tetrakis{3-(4-hydroxy-3,5-di-t-butylphenyl)propionyloxymethyl} methane, 3-(4-hydroxy-3,5-di-t-butylphenyl)propionic acid glycerin monoester, an ester of 3-(4-hydroxy-3,5-di-t-butylphenyl)propionic acid and glycerin monooleyl ether, 3-(4-hydroxy-3,5-di-t-butylphenyl)propionicacid butyleneglycol diester, 3-(4-hydroxy-3,5-di-t-butylphenyl)propionic acid thiodiglycol diester, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 4,6-bis(octylthiomethyl)-o-cresol, 4,6-bis(dodecylthiomethyl)-o-cresol, 2,6-di-t-butyl-4-(N,N'-dimethylaminomethylphenol), bis(3,5-di-t-butyl-4-hydroxybenzyl)sulfide, tris{(3,5-di-t-butyl-4-hydroxyphenyl)propionyl-oxyethyl}isocyanurate, tris(3,5-di-t-butyl-4-hydroxyphenyl)isocyanurate, 1,3,5-tris(3,5-di-t-butyl-4-hydroxybenzyl)isocyanurate, bis{2-methyl-4-(3-n-alkylthiopropionyloxy)-5-t-butylphenyl}sulfide, 1,3,5-tris(4-t-butyl-3-hydroxy-2,6-dimethylbenzyl)isocyanurate, tetraphthaloyl-di(2,6-dimethyl-4-t-butyl-3-hydroxybenzylsulfide), 6-(4-hydroxy-3,5-di-t-butylanilino)-2,4-bis(octylthio)-1,3,5-triazine, 2,2'-thio-diethylenebis[3-(3,5-di-t-butyl-4-hydroxyphenyl)prop ionate], tridecyl-3-(3,5-di-t-butyl-4-hydroxyphenyl)propionate, pentaerythrityl-tetrakis[3-(3,5-di-t-butyl-4-hydroxyphenyl)propionate], octadecyl-3-(3,5-di-t-butyl-4-hydroxyphenyl)propionate, octyl-3-(3,5-di-t-butyl-4-hydroxyphenyl)propionate, heptyl-3-(3,5-di-t-butyl-4-hydroxyphenyl)propionate, octyl-3-(3-methyl-5-t-butyl-4-hydroxyphenyl)propionate, nonyl-3-(3-methyl-5-t-butyl-4-hydroxyphenyl)propionate, hexamethylenebis[3-(3,5-di-t-butyl-4-hydroxyphenyl)propionate], C7-C9 side chain alkyl esters of [3,5-bis(1,1-dimethyl-ethyl)-4-hydroxy]benzenepropionic acid, 2,4,8-tetraoxaspiro[5,5]undecane-3,9-diylbis(2-methylpropane-2,1-diyl)bis[3-(3,5-di-t-butyl-4-hydroxyphenyl)propionate], 3,5-di-t-butyl-4-hydroxy-benzyl-phosphoric acid diester, bis(3-methyl-4-hydroxy-5-t-butylbenzyl)sulfide, 3,9-bis[1,1-dimethyl-2-{β-(3-t-butyl-4-hydroxy-5-methylphenyl) propionyloxylethyl}ethyl]-2,4,8,10-tetraoxaspiro[5,5]undecane, 1,1,3-tris(2-methyl-4-hydroxy-5-t-butylphenyl)butane, 1,1-bis(2-methyl-4-hydroxy-5-t-butylphenyl)butane, 1,3,5-trimethyl-2,4,6-tris(3,5-di-t-butyl-4-hydroxybenzyl) benzene, 2,4,6-tris(3,5-di-t-butyl-4-hydroxybenzyl)mesitylene, 3,5-di-t-butyl-4-hydroxybenzylalkyl esters, and bis{3,3'-bis-(4'-hydroxy-3'-t-butylphenyl)butyric acid}glycol ester;

naphthylamine-based antioxidants such as 1-naphthylamine, phenyl-1-naphthylamine, N-naphthyl-(1,1,3,3-tetramethylbutylphenyl)-1-amine, alkylphenyl-1-naphthylamines, p-octylphenyl-1-naphthylamine, p-nonylphenyl-1-naphthylamine, p-dodecylphenyl-1-naphthylamine, and phenyl-2-naphthylamine; phenylenediamine-based antioxidants such as N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, and phenyloctyl-p-phenylenediamine; diphenylamine-based antioxidants such as dipyridylamine, diphenylamine, dialkylphenylamines, bis(4-n-butylphenyl)amine, bis(4-t-butylphenyl)amine, bis(4-n-pentylphenyl)amine, bis(4-t-pentylphenyl)amine, bis(4-n-octylphenyl)amine, bis(4-(2-ethylhexyl)phenyl)amine, bis(4-nonylphenyl)amine, bis(4-decylphenyl)amine, bis(4-dodecylphenyl)amine, bis(4-styrylphenyl)amine, bis(4-methoxyphenyl)amine, 4,4'-bis(4-α,α-dimethylbenzoyl)diphenylamine, p-isopropoxydiphenylamine, dipyridylamine, and a reaction product of N-phenylbenzenamine and 2,2,4-trimethylpentene; and phenothiazine-based antioxidants such as phenothiazine, N-methylphenothiazine, N-ethylphenothiazine, 3,7-dioctylphenothiazine, phenothiazinecarboxylic acid esters, and phenoselenazine. The blending amount of such antioxidant is preferably from 0.01 mass % to 5 mass %, more preferably from 0.05 mass % to 4 mass % with respect to the base oil.

Examples of the friction-reducing agent include organomolybdenum compounds such as sulfurized oxymolybdenum dithiocarbamates represented by the following general formula (5), sulfurized oxymolybdenum dithiophosphates represented by general formula (6), and products of a reaction between dialkylamines represented by general formula (7) and compounds having a pentavalent or hexavalent molybdenum atom.

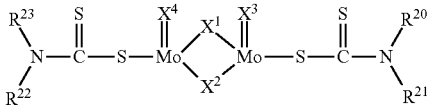

(5)

(Where, $R^{20}$ to $R^{23}$ each independently represent a hydrocarbon group having 1 to 20 carbon atoms, and $X^1$ to $X^4$ each represent a sulfur atom or an oxygen atom.)

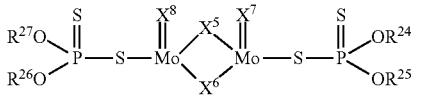

(6)

(Where, $R^{24}$ to $R^{27}$ each independently represent a hydrocarbon group having 1 to 20 carbon atoms, and $X^5$ to $X^8$ each represent a sulfur atom or an oxygen atom.)

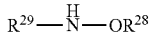

(7)

(Where, $R^{28}$ and $R^{29}$ each independently represent a hydrogen atom or a hydrocarbon group having 1 to 20 carbon atoms, and do not simultaneously represent a hydrogen atom.)

In general formula (5), $R^{20}$ to $R^{23}$ each independently represent a hydrocarbon group having 1 to 20 carbon atoms, and examples of such group include: saturated aliphatic hydrocarbon groups such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, and an icosyl group (each of these groups may be linear or branched and may be primary, secondary, or tertiary); unsaturated aliphatic hydrocarbon groups such as an ethenyl group (vinyl group), a propenyl group (allyl group), a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, and an icosenyl group (each of these groups may be linear or branched and may be primary, secondary, or tertiary); aromatic hydrocarbon groups such as a phenyl group, a tolyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, and a β-naphthyl group; and cycloalkyl groups such as a cyclopentyl group, a cyclohexyl group, a cycloheptyl group, a methylcyclopentyl group, a methylcyclohexyl group, a methylcycloheptyl group, a cyclopentenyl group, a cyclohexenyl group, a cycloheptenyl group, a methylcyclopentenyl group, and a methylcyclohexenyl group, a methylcycloheptenyl group. As in $R^{20}$ to $R^{23}$ in general formula (5), $R^{24}$ to $R^{27}$ in general formula (6), and $R^{28}$ and $R^{29}$ in general formula (7) also each independently represent a hydrocarbon group having 1 to 20 carbon atoms, and examples of such group include the same groups as those described above. The blending amount of such friction-reducing agent is preferably from 30 ppm by mass to 2,000 ppm by mass, more preferably from 50 ppm by mass to 1,000 ppm by mass in terms of a molybdenum content with respect to the base oil.

Examples of the viscosity index improver include poly (C1 to 18)alkylmethacrylates, (C1 to 18)alkylacrylate/(C1 to 18)alkylmethacrylate copolymers, dimethylaminoethyl methacrylate/(C1 to 18)alkylmethacrylate copolymers, ethylene/(C1 to 18)alkylmethacrylate copolymers, polyisobutylene, polyalkylstyrenes, ethylene/propylene copolymers, styrene/maleic acid ester copolymers, hydrogenated styrene/isoprene copolymers, olefin copolymers (OCP), and star polymers. Alternatively, a dispersion-type or multifunctional viscosity index improver to which dispersing performance has been imparted may be used. The weight-average molecular weight of the viscosity index improver is from about 10,000 to 1,500,000, preferably from about 20,000 to 500,000. The blending amount of such viscosity index improver is preferably from 0.1 mass % to 20 mass %, more preferably from 0.3 mass % to 15 mass % with respect to the base oil.

Examples of the pour-point depressant include polyalkyl methacrylates, polyalkyl acrylates, polyalkylstyrenes, ethylene-vinyl acetate copolymers, and polyvinyl acetates. The weight-average molecular weight of the pour-point depressant is from about 1,000 to 100,000, preferably from about 5,000 to 50,000. The blending amount of such pour-point depressant is preferably from 0.005 mass % to 3 mass %, more preferably from 0.01 mass % to 2 mass % with respect to the base oil.

Examples of the rust inhibitor include sodium nitrite, oxidized paraffin wax calcium salts, oxidized paraffin wax magnesium salts, tallow fatty acid alkali metal salts, alkaline earth metal salts, and alkaline earth amine salts, alkenylsuccinic acids, alkenylsuccinic acid half esters (the molecular weight of the alkenyl group is from about 100 to 300), sorbitan monoesters, nonylphenol ethoxylate, and lanolin fatty acid calcium salts. The blending amount of such rust inhibitor is preferably from 0.01 mass % to 3 mass %, more preferably from 0.02 mass % to 2 mass % with respect to the base oil.

Examples of the corrosion inhibitor or the metal deactivator include triazole, tolyltriazole, benzotriazole, benzimidazole, benzothiazole, benzothiadiazole, or 2-hydroxy-N-(1H-1,2,4-triazol-3-yl)benzamide, N,N-bis(2-ethylhexyl)-[(1,2,4-triazol-1-yl)methyl]amine, N,N-bis(2-ethylhexyl)-[(1,2,4-triazol-1-yl)methyl]amine, and 2,2'-[[(4 or 5 or 1)-(2-ethylhexyl)-methyl-1H-benzotriazole-1-methyl]imino] bisethanol, which are derivatives of these compounds, and bis(poly-2-carboxyethyl)phosphinic acid, hydroxyphosphonoacetic acid, tetraalkylthiuram disulfides, N'1,N'12-bis(2-hydroxybenzoyl)dodecane dihydrazide, 3-(3,5-di-t-butyl-hydroxyphenyl)-N'-(3-(3,5-di-tert-butyl-hydroxyphenyl) propanoyl)propane hydrazide, an esterification product of tetrapropenylsuccinic acid and 1,2-propanediol, disodium sebacate, (4-nonylphenoxy)acetic acid, alkylamine salts of mono- and dihexyl phosphates, a sodium salt of tolyltriazole, and (Z)—N-methyl N-(1-oxo-9-octadecenyl)glycine. The blending amount of such corrosion inhibitor is preferably from 0.01 mass % to 3 mass %, more preferably from 0.02 mass % to 2 mass % with respect to the base oil.

Examples of the antifoaming agent include polydimethylsilicone, dimethylsilicone oil, trifluoropropylmethylsilicone, colloidal silica, polyalkylacrylates, polyalkylmethacrylates, alcohol ethoxylate/propoxylates, fatty acid ethoxylate/propoxylates, and sorbitan partial fatty acid esters. The blending amount of such antifoaming agent is preferably from 0.001 mass % to 0.1 mass %, more preferably from 0.001 mass % to 0.01 mass % with respect to the base oil.

When the multifunctional lubricant composition of the present invention is used as an additive for lubrication such as an abrasion-preventing agent, a lubricant base oil except the lubricant base oil of the present invention is preferably used as a lubricant base oil. In addition, the blending amount of the additive for lubrication of the present invention is preferably from 0.01 part by mass to 6 parts by mass with respect to 100 parts by mass of the lubricant base oil. When the blending amount is less than 0.01 part by mass, the amount of an effective component is insufficient and hence the additive may not exhibit an effect as an anti-abrasion agent. When the blending amount is more than 6 parts by mass, the solubility of the additive in the base oil reduces and its effect as an anti-abrasion agent may not be observed. In order that the composition can be used as an additive for lubrication, its solubility in the base oil is preferably good, and it is not preferred that when 0.01 part by mass to 6 parts by mass of the composition is dissolved in 100 parts by mass of the base oil, the insoluble components are found therein as a result of white turbidity, etc.

In addition, when the multifunctional lubricant composition of the present invention is used as an additive for lubrication such as an abrasion-preventing agent, any other additives can be added as long as the effects of the present invention are not impaired. Examples of the other additives that can be used include abrasion-preventing agents, extreme pressure agents, friction modifiers, metal-based cleaning agents, ashless dispersants, antioxidants, friction-reducing agents, viscosity index improvers, pour-point depressants, rust inhibitors, corrosion inhibitors, load-withstanding additives, antifoaming agents, metal deactivators, emulsifiers, demulsifiers, and antimold agents, except the multifunctional lubricant composition of the present invention. It is preferred that 0.001 part by mass to 40 parts by mass of one or more kinds of compounds selected from those additives be incorporated. In addition, those additives are the same as those listed above as the other additives that can be used when the multifunctional lubricant composition of the present invention is used as a flame-retardant base oil for lubrication.

In addition, when the multifunctional lubricant composition of the present invention is used as an additive for lubrication such as an abrasion-preventing agent, the base oil that can be used is not particularly limited, and is appropriately selected from, for example, mineral base oils, chemical synthetic base oils, animal and vegetable base oils, and mixed base oils thereof depending on its intended purpose and use conditions. Here, examples of the mineral base oil include distillates each obtained by distilling, under normal pressure, paraffin base crude oils, intermediate base crude oils, or naphthene base crude oils, or distilling, under reduced pressure, the residual oil of the distillation under normal pressure, and refined oils obtained by refining these distillates in accordance with an ordinary method, specifically solvent-refined oils, hydrogenated refined oils, dewaxed oils, and clay-treated oils. Examples of the chemical synthetic base oil include poly-α-olefins, polyisobutylene (polybutene), diesters, polyol esters, silicic acid esters, polyalkylene glycols, polyphenyl ethers, silicone, fluorinated compounds, and alkylbenzenes. Of those, poly-α-olefins, polyisobutylene (polybutene), diesters, polyol esters, and the like can be used for general purposes. Examples of the poly-α-olefin include polymers or oligomers of 1-hexene, 1-octene, 1-nonene, 1-decene, 1-dodecene, and 1-tetradecene, and hydrogenated products thereof. Examples of the diester include diesters of dibasic acids such as glutaric acid, adipic acid, azelaic acid, sebacic acid, and dodecanedioic acid and alcohols such as 2-ethylhexanol, octanol, decanol, dodecanol, and tridecanol. Examples of the polyol ester include esters of polyols such as neopentyl glycol, trimethylolethane, trimethylolpropane, pentaerythritol, dipentaerythritol, and tripentaerythritol and fatty acids such as caproic acid, carpylic acid, lauric acid, capric acid, myristic acid, palmitic acid, stearic acid, and oleic acid. Examples of the animal and vegetable base oils include: vegetable oils and fats such as castor oil, olive oil, cacao butter, sesame oil, rice bran oil, safflower oil, soybean oil, camellia oil, corn oil, rapeseed oil, palm oil, palm kernel oil, castor oil, sunflower oil, cottonseed oil, and coconut oil; and animal oils and fats such as beef tallow, lard, milk fat, fish oil, and whale oil. One kind of those various base oils described above may be used alone, or two or more kinds thereof may be appropriately used in combination.

EXAMPLES

The present invention is hereinafter specifically described by way of the Examples, but the present invention is by no means limited by the Examples and may be changed as long as the change does not deviate from the scope of the present invention.

Toxicity Data

Toxicity data including triphenyl phosphate and tricresyl phosphate is shown in Table 1 below. Here, the "Results of Eco-toxicity Tests of Chemicals (ver. March 2010, Ministry of the Environment)" is used as a reference for a value for larval medaka (*Oryzias latipes*) acute toxicity 96h-LC50 mg/L, and the "International Uniform Chemical Information Data Base" and the "US Environmental Protection Agency-High Production Volume Information System" are used as references for a value for rainbow trout acute toxicity 96h-LC50 mg/L.

TABLE 1

| Compound name | Larval medaka (*Oryzias latipes*) acute toxicity 96h-LC50 mg/L | Rainbow trout acute toxicity 96h-LC50 mg/L |
|---|---|---|
| Triphenyl phosphate | 1.3 | — |
| Tricresyl phosphate | 0.84 | — |
| Triisopropyl phenyl phosphate | >100 | 1.6 |
| Tri-tert-butylphenyl system (mixture) | — | 13.7 |

The tri-tert-butylphenyl system (mixture) in Table 1 represents a mixture of tri-tert-butylphenyl phosphate, di-tert-butylphenyl phosphate, and mono-tert-butylphenyl phosphate, but their blending ratio is unknown. However, tri-tert-butylphenyl phosphate is phosphorus compound (C) in the multifunctional lubricant composition of the present invention, di-tert-butylphenyl phosphate is phosphorus compound (B) in the multifunctional lubricant composition of the present invention, and mono-tert-butylphenyl phosphate is phosphorus compound (A) in the multifunctional lubricant composition of the present invention, though their blending ratio may be different from the foregoing. Accordingly, the multifunctional lubricant composition of the present invention is expected to exhibit the same toxicity as that of the tri-tert-butylphenyl system (mixture) in Table 1.

Accordingly, the multifunctional lubricant composition of the present invention has lower toxicity and greater safety than phosphorus compounds such as triphenyl phosphate and tricresyl phosphate.

Example 1

Method of Synthesizing Compound II 153.3 Grams (1.0 mol) of phosphorus oxychloride and 166.9 g (1.1 mol) of p-tert-butylphenol were loaded into a four-necked flask having a volume of 1,000 ml mounted with a temperature gauge, a nitrogen-introducing tube, a suction tube for pressure reduction, and an agitator, and 0.3 g of magnesium chloride was further added as a catalyst to the system. After the system had been purged with nitrogen, the temperature in the system was increased to 130° C. while the mixture was stirred, followed by a reaction for 2 hours under normal pressure. After that, the pressure in the system was reduced to $3.0\times10^3$ Pa and a reaction was performed for 2 hours under the reduced pressure. The pressure was returned to normal pressure, 180.6 g (1.9 mol) of phenol was added to the system, and a reaction was further performed at 130° C. for 5 hours. After that, the pressure in the system was reduced to $3.0\times10^3$ Pa, a reaction was performed for 3 hours under the reduced pressure, and the pressure was returned to normal pressure. After that, water washing and the removal of an aqueous layer after the water washing were performed. Finally, dehydration was performed for 2 hours at a temperature of 120° C. and under a reduced pressure of $3.0\times10^3$ Pa. Thus, Compound II was obtained.

Next, Examples 2 to 5 were performed by the same method as the above-mentioned synthesis method. Thus, Compounds III to VI were obtained.

Comparative Example 1

Method of Synthesizing Compound I 153.3 Grams (1.0 mol) of phosphorus oxychloride and 151.7 g (1.0 mol) of p-tert-butylphenol were loaded into a four-necked flask having a volume of 1,000 ml mounted with a temperature gauge, a nitrogen-introducing tube, a suction tube for a pressure reduction, and an agitator, and 0.3 g of magnesium chloride was further added as a catalyst to the system. After the system had been purged with nitrogen, temperature in the system was increased to 130° C. while the mixture was stirred, followed by a reaction for 2 hours. After that, 190.1 g (2.0 mol) of phenol was added to the system and a reaction was further performed at 130° C. for 5 hours. After that, pressure in the system was reduced to $3.0\times10^3$ Pa, a reaction was performed for 3 hours under the reduced pressure, and the pressure was returned to normal pressure. After that, water washing and the removal of an aqueous layer after the water washing were performed, and dehydration was further performed for 2 hours at a temperature of 120° C. and under a reduced pressure of $3.0\times10^3$ Pa. Thus, Compound I was obtained.

Next, Comparative Example 2 was performed by the same method as the above-mentioned synthesis method. Thus, Compound VII was obtained.

The compositions of Compounds I to VII after their syntheses are shown in Table 2.

Example 3

36 Parts by mass of phosphorus compound (B) with respect to 100 parts by mass of phosphorus compound (A)

Example 4

38 Parts by mass of phosphorus compound (B) with respect to 100 parts by mass of phosphorus compound (A)

Example 5

41 Parts by mass of phosphorus compound (B) and 0.7 part by mass of phosphorus compound (C) with respect to 100 parts by mass of phosphorus compound (A)

Comparative Example 2

132 Parts by mass of phosphorus compound (B) and 5 parts by mass of phosphorus compound (C) with respect to 100 parts by mass of the phosphorus compound (A)

Viscosity Data

The results of the measurement of the kinematic viscosities of Compounds I to VII at 40° C. are shown in Table 3. The viscosity-measuring instrument used here is a stabinger viscometer "SVM 3000" manufactured by Anton Paar.

TABLE 2

| | | Raw material loading amount (mol) | | | Composition of synthesized product | | | |
|---|---|---|---|---|---|---|---|---|
| | Compound | Phosphorus oxychloride | p-tert-butylphenol | Phenol | Phosphorus compound (A) % | Phosphorus compound (B) % | Phosphorus compound (C) % | TPP % |
| Comparative Example 1 | I | 1.0 | 1.0 | 2.0 | 95 | 4 | 0.5> | 0.5> |
| Example 1 | II | 1.0 | 1.1 | 1.9 | 78 | 21 | 0.5> | 0.5> |
| Example 2 | III | 1.0 | 1.15 | 1.85 | 76 | 23 | 0.5> | 0.5> |
| Example 3 | IV | 1.0 | 1.2 | 1.8 | 73 | 26 | 0.5> | 0.5> |
| Example 4 | V | 1.0 | 1.25 | 1.75 | 71 | 27 | 0.5> | 0.5> |
| Example 5 | VI | 1.0 | 1.3 | 1.7 | 70 | 29 | 0.5 | 0.5> |
| Comparative Example 2 | VII | 1.0 | 1.5 | 1.5 | 41 | 54 | 2 | 0.5> |

Comparative Example 1

4 Parts by mass of phosphorus compound (B) with respect to 100 parts by mass of phosphorus compound (A)

Example 1

27 Parts by mass of phosphorus compound (B) with respect to 100 parts by mass of phosphorus compound (A)

Example 2

30 Parts by mass of phosphorus compound (B) with respect to 100 parts by mass of phosphorus compound (A)

TABLE 3

| | Compound | Kinematic viscosity at 40° C. ($mm^2/s$) | Density at 25° C. ($g/cm^3$) |
|---|---|---|---|
| Comparative Example 1 | I | 36.6 | 1.15 |
| Example 1 | II | 45.3 | 1.14 |
| Example 2 | III | 44.9 | 1.14 |
| Example 3 | IV | 47.7 | 1.14 |
| Example 4 | V | 50.2 | 1.14 |
| Example 5 | VI | 51.3 | 1.14 |
| Comparative Example 2 | VII | 74.9 | 1.12 |

The multifunctional lubricant composition of the present invention satisfies an appropriate viscosity range (kinematic viscosity at 40° C. of from 30 $mm^2/s$ to 55 $mm^2/s$) required when used as a base oil for lubrication, and it is recognized that this viscosity range is easy to handle when the composition is also used as an additive. On the other hand, Comparative Example 2 has a high viscosity owing to the influences of the phosphorus compounds (B) and (C), and is hence not suitable for use as a base oil for lubrication. Further, it may be difficult to handle the composition even when the composition is used as an additive.

Solubility Data

When each of Compounds I to VII are used as additives for lubrication, it is essential that their solubility in a base oil be good. In view of the foregoing, a test for solubility in the base oil was performed. The results are shown in FIG. 2. The method for the test is as described below.

<Test Method>

Solutions I to VII were prepared by adding 6 parts by mass each of Compounds I to VII to 100 parts by mass of a base oil, respectively. Solutions I to VII were each stirred under heat at 50° C. for 1 hour so that Compounds I to VII were each dissolved in the base oil. After that, the solutions were left to stand for several hours at room temperature and left at rest in a thermostat at 25° C. for 1 week. The base oil used here is a mineral oil having a kinematic viscosity at 40° C. of 19.5 $mm^2/s$ and a viscosity index of 123.

<Evaluation Method>

The case where a compound completely dissolved, and hence a sample after the completion of the solubility test was colorless and transparent was evaluated as Symbol "○○", the case where cloudiness appeared in a sample after the completion of the test was evaluated as Symbol "○", the case where turbidity, a precipitate, or an insoluble component appeared in a sample after the completion of the test was evaluated as Symbol "Δ", and the case where a compound was insoluble and hence the test could not be performed was evaluated as Symbol "x".

As a result, the multifunctional lubricant composition of the present invention exhibited good solubility and hence can be used as an additive for lubrication. On the other hand, Comparative Example 1 was not suitable for use as an additive for lubrication because opacification due to an insoluble component was observed.

Lubrication Characteristic Test

The multifunctional lubricant composition of the present invention was evaluated for its abrasion resistance. Compounds I to VII themselves used as base oils for lubrication, and Solutions II to VII using Compounds II to VII as additives for lubrication were subjected to the test (Compound I was not evaluated for its abrasion resistance as an additive because it was found from the solubility test described in the foregoing that its solubility in a base oil was poor).

Before the performance of the evaluation, Solutions II to VII using Compounds II to VII as additives were each further diluted with a base oil so that the ratio of each of Compounds II to VII to the base oil was adjusted to 0.1 wt %. As in the solubility test, the base oil used here is a mineral oil having a kinematic viscosity at 40° C. of 19.5 $mm^2/s$ and a viscosity index of 123.

The test was performed with an SRV tester (manufacturer name: Optimol, model: type 3) under the following conditions by a ball-on-disk method, and the size of an abrasion mark left on a ball after the test was evaluated.

Test Condition

Load 200 N
Amplitude 4.0 mm
Frequency 20 Hz
Temperature 80° C.
Time 60 min

Evaluation Method

○○: Diameter of Abrasion Mark 0.40 mm-0.55 mm
○: Diameter of Abrasion Mark 0.56 mm-0.70 mm
Δ: Diameter of Abrasion Mark 0.71 mm-0.85 mm
x: Diameter of Abrasion Mark 0.86 mm-1.00 mm Abrasion Resistance Evaluation Results are shown in Tables 5 and 6 below.

TABLE 5

| | Comparative Example 1 Compound I | Example1 Compound II | Example2 Compound III | Example3 Compound IV | Example4 Compound V | Example5 Compound VI | Comparative Example 2 Compound VII |
|---|---|---|---|---|---|---|---|
| Abrasion Resistance Evaluation Result (evaluation as base oil) | ○ | ○ | ○ | ○ | ○ | ○ | ○ |

TABLE 6

| | Base oil | Example 1 Solution II | Example 2 Solution III | Example 3 Solution IV | Example 4 Solution V | Example 5 Solution VI | Comparative Example 2 Solution VII |
|---|---|---|---|---|---|---|---|
| Abrasion Resistance Evaluation Result (evaluation as additive) | x | ○○ | ○○ | ○○ | ○○ | ○○ | Δ |

Accordingly, it was found that the multifunctional lubricant composition of the present invention exhibited extremely good abrasion resistance when used as an additive for lubrication, and exhibited abrasion resistance even when used as a base oil for lubrication.

Hydrolyzability Data

The multifunctional lubricant composition (Example 3) of the present invention was examined for its hydrolyzability.

<Test Method>

1 Mass percent of water was added to phosphorus compounds and the mixture was stored in a thermostat at 60° C. The compounds were evaluated for hydrolyzability by measuring an acid value at each number of days elapsed. The results are shown in FIG. 1.

As can be seen from FIG. 1, TPP has high hydrolyzability and the multifunctional lubricant composition (Example 3) of the present invention had lower hydrolyzability than that of TPP.

INDUSTRIAL APPLICABILITY

The composition of the present invention is a multifunctional lubricant composition that can be used as a base oil for lubrication and as an additive for lubrication. The composition brings together performances such as flame retardancy and abrasion resistance, and is environmentally-friendly and safe because the composition has low toxicity and high hydrolysis resistance. The compound is expected to be used as an alternative compound to triphenyl phosphate and tricresyl phosphate, and to attract attention, in the lubrication industry and other wide variety of industries in the future.

The invention claimed is:

1. A lubricating oil composition comprising a base oil for lubrication and an additive for lubrication, wherein the additive for lubrication comprises, with respect to 100 parts by mass of phosphorus compound (A) represented by the following formula (1), 26 parts by mass to 43 parts by mass of phosphorus compound (B) represented by the following formula (2), 0 parts by mass to 1.3 parts by mass of phosphorus compound (C) represented by the following formula (3), and a total of 0 parts by mass to 1.3 parts by mass of triphenyl phosphate and tricresyl phosphate, wherein the lubricating oil composition comprises 0.01 part by mass to 6 parts by mass of the additive for lubrication with respect to 100 parts by mass of the base oil for lubrication, and wherein the additive for lubrication is a different oil from the base oil for lubrication:

(1)

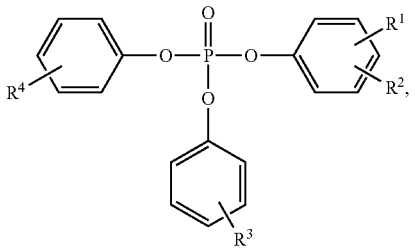

wherein $R^1$ represents a hydrocarbon group having 1 to 10 carbon atoms, $R^2$ represents a hydrogen atom or a hydrocarbon group having 1 to 10 carbon atoms, and $R^3$ and $R^4$ each independently represent a hydrogen atom or a methyl group, provided that when $R^1$ represents a methyl group, $R^2$ does not represent a hydrogen atom;

(2)

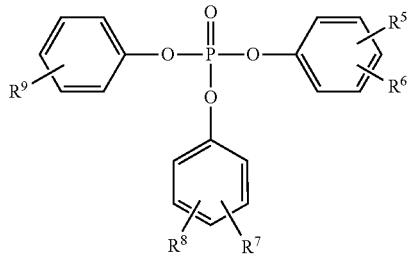

wherein $R^5$ and $R^7$ each independently represent a hydrocarbon group having 1 to 10 carbon atoms, $R^6$ and $R^8$ each independently represent a hydrogen atom or a hydrocarbon group having 1 to 10 carbon atoms, and $R^9$ represents a hydrogen atom or a methyl group, provided that when $R^5$ represents a methyl group, $R^6$ does not represent a hydrogen atom, and that when $R^7$ represents a methyl group, $R^8$ does not represent a hydrogen atom;

(3)

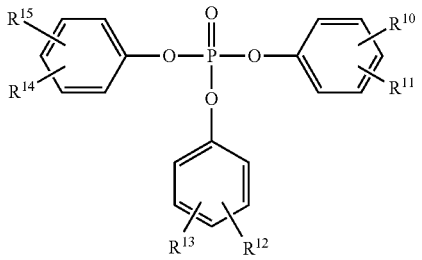

wherein $R^{10}$, $R^{12}$, and $R^{14}$ each independently represent a hydrocarbon group having 1 to 10 carbon atoms, and $R^{11}$, $R^{13}$, and $R^{15}$ each independently represent a hydrogen atom or a methyl group, provided that when $R^{10}$ represents a methyl group, $R^{11}$ does not represent a hydrogen atom, that when $R^{12}$ represents a methyl group, $R^{13}$ does not represent a hydrogen atom, and that when $R^{14}$ represents a methyl group, $R^{15}$ does not represent a hydrogen atom.

2. The lubricating oil composition according to claim 1, wherein $R^1$ represents a hydrocarbon group having 2 to 5 carbon atoms at a para position and $R^2$ to $R^4$ each represent a hydrogen atom in compound (A) represented by the formula (1), $R^5$ and $R^7$ each represent a hydrocarbon group having 2 to 5 carbon atoms at a para position and $R^6$, $R^8$, and $R^9$ each represent a hydrogen atom in compound (B) represented by the formula (2), and $R^{10}$, $R^{12}$, and $R^{14}$ each represent a hydrocarbon group having 2 to 5 carbon atoms at a para position and $R^{11}$, $R^{13}$, and $R^{15}$ each represent a hydrogen atom in compound (C) represented by the formula (3).

3. The lubricating oil composition according to claim 2, wherein the $R^1$, $R^5$, $R^7$, $R^{10}$, $R^{12}$, and $R^{14}$ each represent a t-butyl group.

4. The lubricating oil composition according to claim 1, further comprising 0.001 part by mass to 40 parts by mass of at least one compound selected from the group consisting of an abrasion-preventing agent, an extreme pressure agent, a friction modifier, a metal-based cleaning agent, an ashless dispersant, an antioxidant, a friction-reducing agent, a viscosity index improver, a pour-point depressant, a rust inhibitor, a corrosion inhibitor, a metal deactivator, and an antifoaming agent, with respect to 100 parts by mass of the base oil for lubrication.

5. A method for enhancing abrasion resistance in a base oil for lubrication, comprising adding an additive for lubrication to the lubricant base oil, wherein the additive for lubrication comprises, with respect to 100 parts by mass of phosphorus compound (A) represented by the following formula (1), 26 parts by mass to 43 parts by mass of phosphorus compound (B) represented by the following formula (2), 0 parts by mass to 1.3 parts by mass of phosphorus compound (C) represented by the following formula (3), and a total of 0 parts by mass to 1.3 parts by mass of triphenyl phosphate and tricresyl phosphate, wherein the lubricating oil composition comprises 0.01 part by mass to 6 parts by mass of the additive for lubrication with respect to 100 parts by mass of the base oil for lubrication, and wherein the additive for lubrication is a different oil from the base oil for the lubrication:

(1)

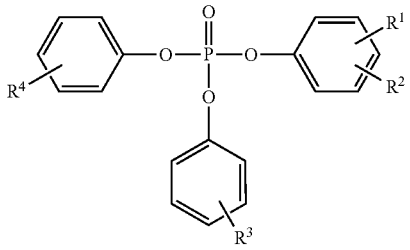

wherein $R^1$ represents a hydrocarbon group having 1 to 10 carbon atoms, $R^2$ represents a hydrogen atom or a hydrocarbon group having 1 to 10 carbon atoms, and $R^3$ and $R^4$ each independently represent a hydrogen atom or a methyl group, provided that when $R^1$ represents a methyl group, $R^2$ does not represent a hydrogen atom;

(2)

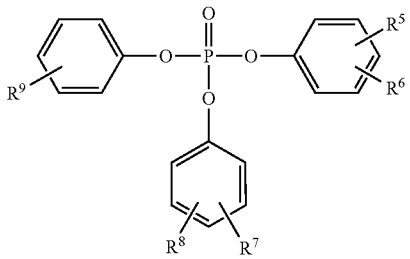

wherein $R^5$ and $R^7$ each independently represent a hydrocarbon group having 1 to 10 carbon atoms, $R^6$ and $R^8$ each independently represent a hydrogen atom or a hydrocarbon group having 1 to 10 carbon atoms, and $R^9$ represents a hydrogen atom or a methyl group, provided that when $R^5$ represents a methyl group, $R^6$ does not represent a hydrogen atom, and that when $R^7$ represents a methyl group, $R^8$ does not represent a hydrogen atom;

(3)

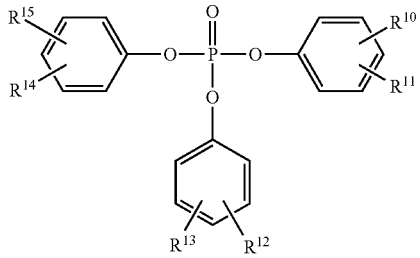

wherein $R^{10}$, $R^{12}$, and $R^{14}$ each independently represent a hydrocarbon group having 1 to 10 carbon atoms, and $R^{11}$, $R^{13}$, and $R^{15}$ each independently represent a hydrogen atom or a methyl group, provided that when $R^{10}$ represents a methyl group, $R^{11}$ does not represent a hydrogen atom, that when $R^{12}$ represents a methyl group, $R^{13}$ does not represent a hydrogen atom, and that when $R^{14}$ represents a methyl group, $R^{15}$ does not represent a hydrogen atom.

* * * * *